US011851842B2

(12) United States Patent
Nakatani et al.

(10) Patent No.: US 11,851,842 B2
(45) Date of Patent: Dec. 26, 2023

(54) HYDRAULIC EXCAVATOR

(71) Applicants: Hitachi Construction Machinery Co., Ltd., Tokyo (JP); Hitachi Construction Machinery Tierra Co., Ltd., Koka (JP)

(72) Inventors: Kenichiro Nakatani, Kusatsu (JP); Shinya Imura, Toride (JP)

(73) Assignees: Hitachi Construction Machinery Co., Ltd., Tokyo (JP); Hitachi Construction Machinery Tierra Co., Ltd., Koka (JP)

( * ) Notice: Subject to any disclaimer, the term of this patent is extended or adjusted under 35 U.S.C. 154(b) by 612 days.

(21) Appl. No.: 17/059,930

(22) PCT Filed: Mar. 26, 2019

(86) PCT No.: PCT/JP2019/013042

§ 371 (c)(1),
(2) Date: Nov. 30, 2020

(87) PCT Pub. No.: WO2020/194559

PCT Pub. Date: Oct. 1, 2020

(65) Prior Publication Data

US 2021/0207339 A1 Jul. 8, 2021

(51) Int. Cl.

| | |
|---|---|
| ***E02F 3/43*** | (2006.01) |
| ***E02F 3/84*** | (2006.01) |
| ***E02F 9/26*** | (2006.01) |

(52) U.S. Cl.

CPC ..... *E02F 3/43* (2013.01); *E02F 3/847* (2013.01); *E02F 9/265* (2013.01)

(58) Field of Classification Search

CPC ..... E02F 3/43–439; E02F 3/841–847; E02F 9/2025; E02F 9/2037; E02F 9/2041; E02F 9/2045; E02F 9/264; E02F 9/265

See application file for complete search history.

(56) References Cited

U.S. PATENT DOCUMENTS 4,273,196 A 6/1981 Etsusaki et al.
5,950,426 A 9/1999 Morita et al.
(Continued)

FOREIGN PATENT DOCUMENTS

JP 54-150802 A 11/1979
JP 7-11665 A 1/1995
(Continued)

OTHER PUBLICATIONS

International Search Report (PCT/ISA/210) issued in PCT Application No. PCT/JP2019/013042 dated Jun. 11, 2019 with English translation (four (4) pages).
(Continued)

*Primary Examiner* — Spencer D Patton
(74) *Attorney, Agent, or Firm* — Crowell & Moring LLP

(57) ABSTRACT

In a hydraulic excavator including a track structure, a swing structure swingably disposed on an upper portion of the track structure, a work implement coupled to the swing structure, an earth removal device including a blade coupled to the track structure and a lift cylinder configured to raise and lower the blade, an operation sensor configured to detect an operation of a travelling lever, a height sensor configured to measure a height of the blade with respect to the track structure, an antenna for a satellite positioning system, the antenna being mounted on the swing structure, and a controller configured to calculate positional data regarding the blade, the controller is configured to determine a travelling operation on the basis of a signal of the operation sensor, calculate a travelling direction of straight forward travelling of the track structure as an orientation of the track structure when the straight forward travelling of the track structure is detected from a trajectory of the antenna with a state in which no turn travelling operation is being performed as a precondition, calculate horizontal coordinates of the blade
(Continued)

on the basis of the orientation of the track structure, and calculate the height of the blade on the basis of a position of the antenna and a measured value of the height sensor.

7 Claims, 9 Drawing Sheets

(56) References Cited

U.S. PATENT DOCUMENTS

| | | | | |
|---|---|---|---|---|
| 2006/0041361 | A1 | 2/2006 | Matrosov | |
| 2013/0081836 | A1 | 4/2013 | Hayashi et al. | |
| 2018/0340315 | A1 | 11/2018 | Metzger et al. | |
| 2019/0249391 | A1* | 8/2019 | Kikuchi | E02F 3/845 |
| 2020/0071909 | A1* | 3/2020 | Harada | G05D 1/0212 |

FOREIGN PATENT DOCUMENTS

| | | | |
|---|---|---|---|
| JP | 7-197486 | A | 8/1995 |
| JP | 7-243225 | A | 9/1995 |
| JP | 7-317098 | A | 12/1995 |
| JP | 5247938 | B1 | 7/2013 |
| JP | 5356141 | B2 | 12/2013 |
| WO | WO 2018/179577 | A1 | 10/2018 |
| WO | WO 2018/179963 | A1 | 10/2018 |

OTHER PUBLICATIONS

Japanese-language Written Opinion (PCT/ISA/237) issued in PCT Application No. PCT/JP2019/013042 dated Jun. 11, 2019 (six (6) pages).

International Preliminary Report on Patentability (PCT/IB/338 & PCT/IB/373) issued in PCT Application No. PCT/JP2019/013042 dated Oct. 7, 2021, including English translation of document C2 (Japanese-language Written Opinion (PCT/ISA/237), filed on Nov. 30, 2020) (13 pages).

* cited by examiner

HYDRAULIC EXCAVATOR

TECHNICAL FIELD

The present invention relates to a hydraulic excavator having a blade provided to a track structure, and particularly, to a hydraulic excavator in which a swing structure swings with respect to a track structure.

BACKGROUND ART

There is a bulldozer that has a GNSS antenna installed on a blade and performs what is generally called computer aided construction on the basis of positional data regarding the blade which positional data is received by the GNSS antenna (Patent Document 1). In addition, also known is a bulldozer which has a GNSS antenna installed above a cab, calculates the position of a blade on the basis of positional data regarding a machine body which positional data is received by the GNSS antenna and a stroke of a cylinder that drives the blade, and performs computer aided construction (Patent Document 2).

PRIOR ART DOCUMENT

Patent Documents

Patent Document 1: Japanese Patent No. 5356141
Patent Document 2: Japanese Patent No. 5247938

SUMMARY OF THE INVENTION

Problem to be Solved by the Invention

Some hydraulic excavators also have a blade. However, unlike a bulldozer, a work implement fitted with an attachment such as a bucket is mainly used in work of a hydraulic excavator. In addition, when a GNSS antenna is installed on the blade, there is a possibility that soil scraped up by the blade and the work implement interfere with the GNSS antenna. For these reasons, in the hydraulic excavator, the GNSS antenna is preferably installed on a swing structure provided with the work implement.

However, while the blade is provided to a track structure, the swing structure swings with respect to the track structure, and therefore, positional relation between the swing structure and the blade changes as the swing structure swings. In a case where the GNSS antenna is installed on the swing structure, the position of the blade cannot be obtained from the positional data regarding the GNSS antenna in a state in which the positional relation between the swing structure and the blade is unknown. In addition, because the GNSS antenna is expensive, there is a desire to construct a system that can calculate the position of the blade necessary for computer aided construction even with one GNSS antenna.

It is an object of the present invention to provide a hydraulic excavator that can calculate the positional data regarding a blade by using the positional data regarding one antenna installed on a swing structure.

Means for Solving the Problem

In order to achieve the above object, according to the present invention, there is provided a hydraulic excavator including a track structure, a swing structure swingably disposed on an upper portion of the track structure, a work implement coupled to the swing structure, an earth removal device including a blade coupled to the track structure and a lift cylinder configured to raise and lower the blade, a travelling lever configured to operate the track structure, an operation sensor configured to detect an operation of the travelling lever, a height sensor configured to measure a height of the blade with respect to the track structure, an antenna for a satellite positioning system, the antenna being mounted on the swing structure, and a controller configured to calculate positional data regarding the blade and perform control of raising or lowering the blade so as to approach a target surface stored in advance on the basis of the positional data. In the hydraulic excavator, in a state in which no turn travelling operation is determined as being performed, on the basis of a signal of the operation sensor, the controller calculates a travelling direction of straight forward travelling as an orientation of the track structure when determining that the track structure is performing the straight forward travelling from a trajectory of the antenna, the trajectory being obtained from positional data regarding the antenna, calculates horizontal coordinates of the blade on the basis of the orientation of the track structure and data regarding relation between a position of the antenna and a position of the blade, the data being stored in advance, and computes the positional data by calculating the height of the blade on the basis of the position of the antenna, a measured value of the height sensor, and the data regarding the relation between the position of the antenna and the position of the blade, the data being stored in advance.

Advantages of the Invention

According to the present invention, it is possible to calculate the positional data regarding the blade by using the positional data regarding one antenna installed on the swing structure.

MODES FOR CARRYING OUT THE INVENTION

Embodiments of the present invention will hereinafter be described with reference to the drawings.

First Embodiment

—Hydraulic Excavator—

Figure 1:
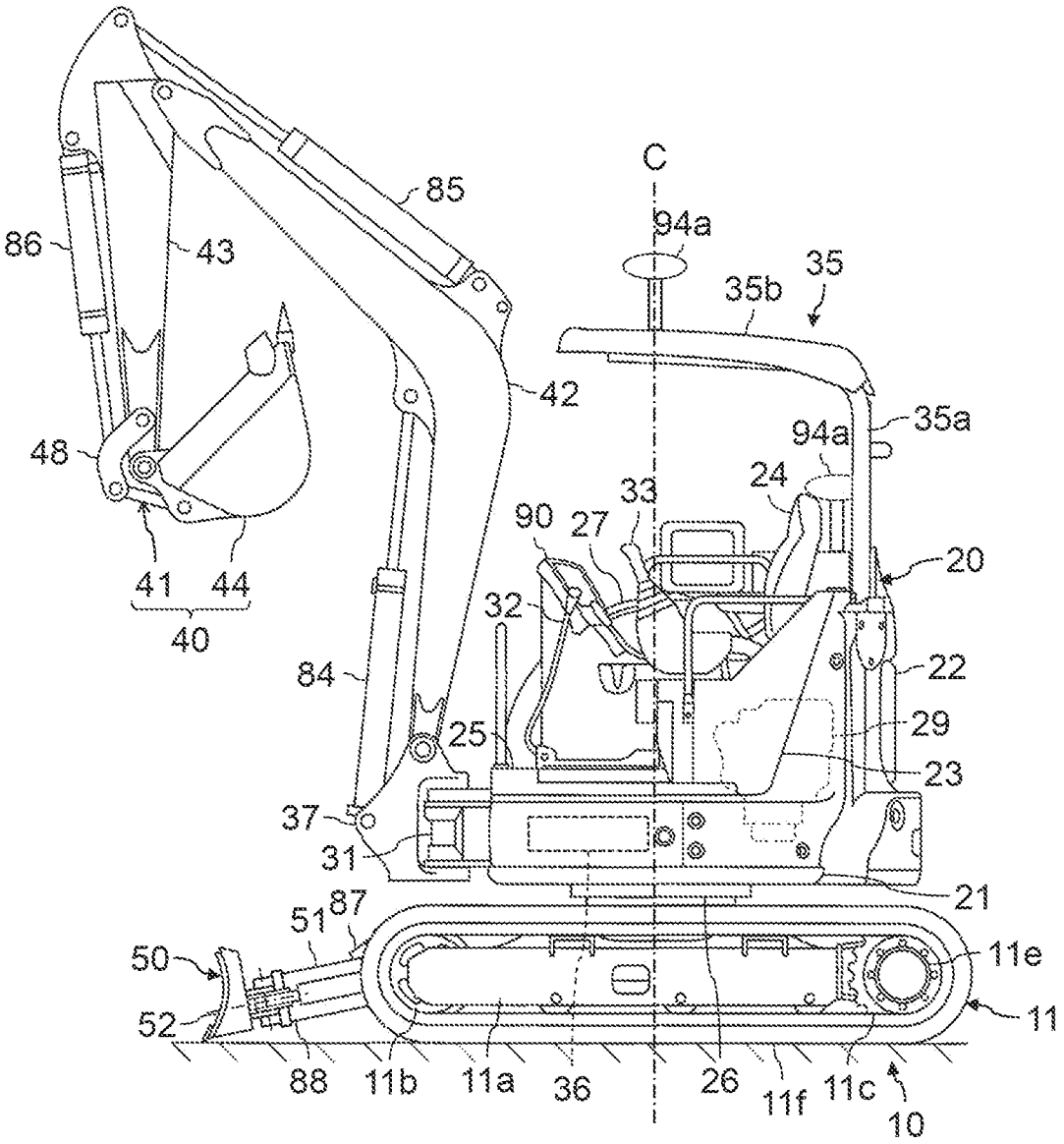
FIG. 1 is a side view of a hydraulic excavator according to a first embodiment of the present invention.
Figure 2:
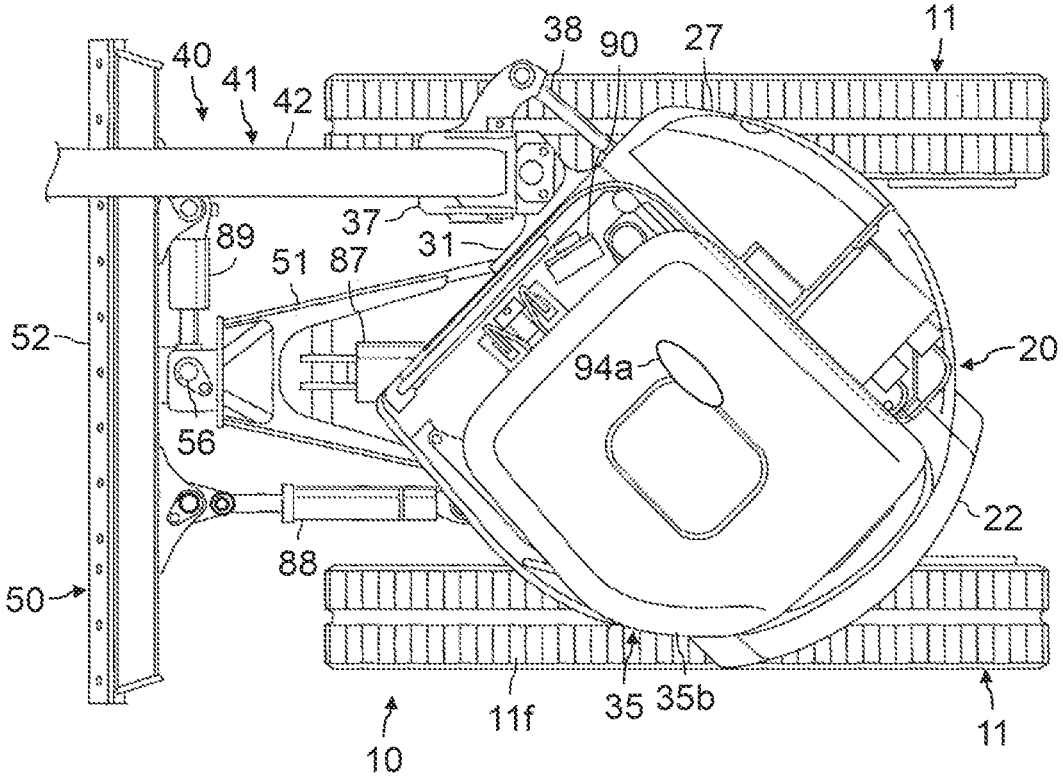
FIG. 2 is a plan view of the hydraulic excavator illustrated in FIG. 1.

FIG. 1 is a side view of a hydraulic excavator according to a first embodiment of the present invention. FIG. 2 is a plan view of the hydraulic excavator according to the first embodiment of the present invention. In the specification of the present application, a front and a rear are defined with reference to a track structure. A side on which an earth removal device 50 is installed is set as the front, and an opposite side thereof is set as the rear. The hydraulic excavator illustrated in FIG. 1 and FIG. 2 includes a track structure 10, a swing structure 20, a work implement 40, the earth removal device 50, and a controller (computer) 60.

—Track Structure—

The track structure 10 includes left and right track devices 11. The left and right track devices 11 are of a crawler type. The left and right track devices 11 each include a side frame 11*a*, a driven wheel 11*b*, a driving wheel 11*c*, a travelling motor (FIG. 3), a reduction gear 11*e*, and a crawler 11*f*. The side frame 11*a* is a frame of the track device 11. The left and right side frames 11*a* and a center frame coupling these side frames to each other constitute a track frame having the shape of an H as viewed in plan. The side frame 11*a* extends in a forward-rearward direction and supports the driven wheel 11*b* on one side (front side in the present example) in the forward-rearward direction and the driving wheel 11*c* on another side (rear side in the present example). The travelling motor is supported on the other side in the forward-rearward direction of the left and right side frames 11*a*. An output power shaft is coupled to the driving wheel 11*c* via the reduction gear 11*e*. In each of the left and right track devices 11, the crawler 11*f* is wound around the driven wheel 11*b* and the driving wheel 11*c*. When the travelling motor is driven, rotational power is transmitted to the driving wheel 11*c* via the reduction gear 11*e*, and the crawler 11*f* is circularly driven between the driving wheel 11*c* and the driven wheel 11*b*.

—Swing Structure—

The swing structure 20 is swingably provided to an upper portion of the track structure 10. The swing structure 20 includes a swing frame 21, a counter weight 22, a seat base 23, a cab seat 24, a floor panel 25, and the like. The swing frame 21 is a base frame of the swing structure 20. The swing frame 21 is swingably provided to an upper portion of the center frame of the track structure 10 via a swing wheel 26. Machinery such as an engine 29 (broken line in FIG. 1) and hydraulic pumps 30*a* and 30*b* (FIG. 3) driven by the engine 29 is mounted on an area on a rear side in the swing frame 21. The present embodiment illustrates a case in which the engine 29 (internal combustion engine) is used as a prime mover that drives the hydraulic pumps. However, a motor may be used in place of the engine 29. A hydraulic operating oil tank and a fuel tank are mounted on a right front part of the swing frame 21. These tanks are covered by a tank cover 27. In addition, a supporting bracket 31 is provided to a front portion of the swing frame 21. A swing post 37 is coupled to the supporting bracket 31 via a vertical shaft. A swing cylinder 38 rotation-drives the swing post 37 left and right. The counter weight 22 is a weight for adjusting a balance with the work implement 40. The counter weight 22 is provided to a rear edge portion of the swing frame 21 so as to extend vertically. The swing radius of a rear edge portion of the counter weight 22 is the rear swing diameter of the hydraulic excavator. However, the hydraulic excavator according to the present embodiment is a small-sized model, and the rear swing diameter is limited to approximately the vehicle width of the track structure 10.

The seat base 23 is supported by the swing frame 21 so as to be located on the front side of the counter weight 22. The seat base 23 serves also as an engine cover and covers the machinery such as the engine 29 and the hydraulic pumps 30*a* and 30*b*. The cab seat 24 is fixedly installed on the seat base 23. The floor panel 25 is located on the front side of the seat base 23 and the cab seat 24 and forms a boarding and alighting passage for an operator or the like. A directional control valve unit 36 (see a broken line in FIG. 1) that controls the direction and flow rate of hydraulic operating oil supplied from the hydraulic pumps to each hydraulic actuator included in the hydraulic excavator such as the travelling motor is disposed on the lower side of the floor panel 25.

A travelling lever 32 for operating the left and right track devices 11 is disposed on a front portion of the floor panel 25. Left and right control levers 33 for operating the work implement 40 and the swing structure 20 are respectively arranged on the left and right of the cab seat 24 on the seat base 23. In addition, a two-column type canopy 35 is provided to the swing structure 20. The canopy 35 includes left and right pillars 35*a* rising from a rear portion of the seat base 23 and a roof 35*b* supported by the left and right pillars 35*a*. An upper side of the cab seat 24 is covered by the roof 35*b*.

—Work Implement—

The work implement 40 is an articulated arm type front work device (swing post type in the present example) provided to a front portion of the swing structure 20 to perform work such as soil excavation. The work implement 40 includes a work arm 41 and an attachment 44. The work arm 41 includes a boom 42, an arm 43, a boom cylinder 84, an arm cylinder 85, and an attachment cylinder 86. The boom 42 is coupled to the front portion of the swing structure 20 (the above-described swing post 37). The arm 43 is coupled to a distal end of the boom 42. The attachment 44 is coupled to a distal end of the arm 43. The boom 42, the arm 43, and the attachment 44 each rotate with a pin horizontally extending to the left and right as a pivot. FIG. 1 illustrates an example in which the work arm 41 is fitted with a bucket as the attachment 44. However, the kind of the attachment to be fitted is not limited to this, and the attachment can be replaced with another attachment such as a breaker or a grapple, as appropriate. In addition, both ends of the boom cylinder 84 are coupled to the swing structure 20 (swing post 37) and the boom 42. Both ends of the arm cylinder 85 are coupled to the boom 42 and the arm 43. A proximal end of the attachment cylinder 86 is coupled to the arm 43, whereas a distal end of the attachment cylinder 86 is coupled to a distal end portion of the arm 43 and the attachment 44 via a link 48. The boom cylinder 84, the arm cylinder 85, and the attachment cylinder 86 are each a hydraulic actuator, are driven by the hydraulic operating oil delivered from the hydraulic pumps, and drive the work implement 40 by expanding and contracting operation.

—Earth Removal Device—

The earth removal device 50 is provided to a front portion of the track frame (center frame) of the track structure 10. As illustrated in FIG. 2, the earth removal device 50 includes a lift arm 51, a blade 52, a lift cylinder 87, an angle cylinder 88, and a tilt cylinder 89. The lift arm 51 is a member having the shape of a letter V as viewed in plan. A proximal end side of the lift arm 51 is coupled to a front portion of the center frame of the track structure 10 so as to be rotatable vertically. The blade 52 is a plate-shaped member extending in a left-right direction. A central portion on a rear surface side of the blade 52 is coupled to a distal end side of the lift arm 51 via a universal pin 56 having degrees of freedom on a plurality of axes. The blade 52 is thus coupled to the track structure 10 via the lift arm 51. The lift cylinder 87, the angle cylinder 88, and the tilt cylinder 89 are hydraulic actuators that drive the blade 52.

The lift cylinder 87 is a cylinder that raises and lowers the blade 52 by driving the lift arm 51 upward and downward. The lift cylinder 87 couples the lift arm 51 and the center frame to each other. When the blade 52 is lowered, for example, by driving the lift cylinder 87 during travelling of the hydraulic excavator, the blade 52 can scrape a ground surface and create a site to be prepared. The angle cylinder 88 is a cylinder that rotates the blade 52 about the universal pin 56 along a horizontal plane. In the present example, the angle cylinder 88 couples a left side portion of the lift arm 51 and the blade 52 to each other. When the blade 52 is inclined along the horizontal plane such that one side of the blade 52 in the left-right direction is retreated with respect to another side of the blade 52 by driving the angle cylinder 88 during travelling, a soil scraped out by the blade 52 can be discharged to the other side in the left-right direction. The tilt cylinder 89 is a cylinder that rotates the blade 52 (inclines the blade 52 rightwardly downward or leftwardly downward) about the universal pin 56 along a vertical plane extending left and right. The tilt cylinder 89 extends in the left-right direction along the rear surface of the blade 52, is disposed at a height offset from the universal pin 56, and couples the lift arm 51 and the blade 52 to each other. When the blade 52 is inclined rightwardly downward or leftwardly downward by driving the tilt cylinder 89 during travelling, a site having a gradient can be created.

—Driving System—

Figure 3:
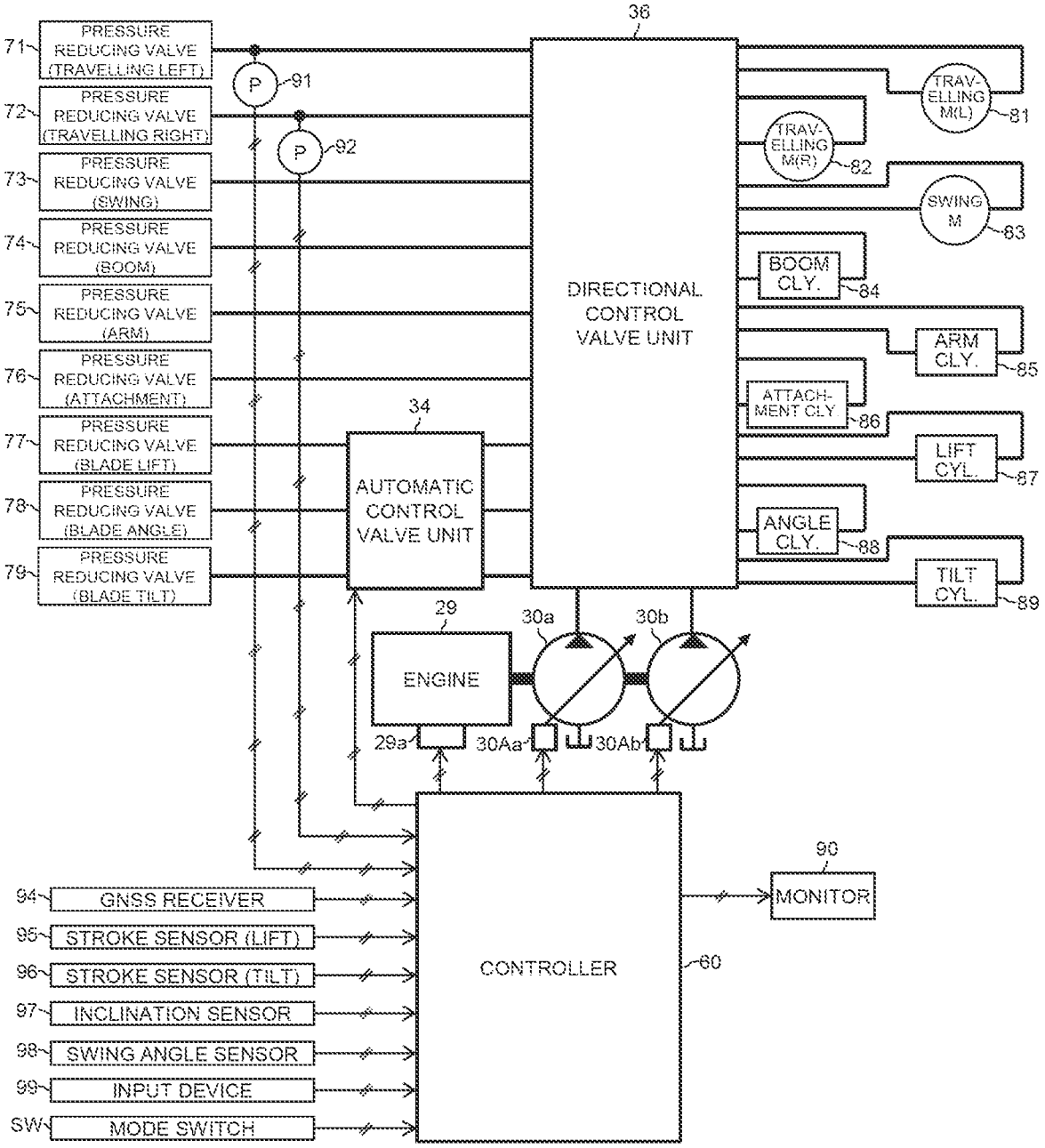
FIG. 3 is a schematic diagram of a driving system provided to the hydraulic excavator illustrated in FIG. 1.

FIG. 3 is a schematic diagram of a driving system provided to the hydraulic excavator according to the present embodiment. This system includes the engine 29, an engine controller 29*a*, the hydraulic pumps 30*a* and 30*b*, regulators 30Aa and 30Ab, an automatic control valve unit 34, the directional control valve unit 36, pressure reducing valves 71 to 79, and the controller 60.

Engine/Engine Controller

The engine controller 29*a* is a controller that controls the revolution speed of the engine 29. The engine controller 29*a* adjusts a fuel injection amount and fuel injection timing of the engine 29 so that an actual engine speed coincides with a target engine speed input from the controller 60.

Hydraulic Pump/Regulator

The hydraulic pumps 30*a* and 30*b* are pumps of a variable displacement type that deliver the hydraulic operating oil for driving various hydraulic actuators. The hydraulic pumps 30*a* and 30*b* are rotation-driven by the engine 29 and deliver the hydraulic operating oil proportional to a product of a revolution speed and a volume. The regulators 30Aa and 30Ab are devices that control the volumes (tilting) of the hydraulic pumps 30*a* and 30*b*. The regulators 30Aa and 30Ab are driven by a command input from the controller 60. Illustrated as hydraulic actuators in FIG. 3 are travelling motors 81 and 82, a swing motor 83, the boom cylinder 84, the arm cylinder 85, the attachment cylinder 86, the lift cylinder 87, the angle cylinder 88, and the tilt cylinder 89. The swing cylinder 38 is not illustrated. The travelling motors 81 and 82 are hydraulic motors that drive the left and right track devices 11, respectively. The swing motor 83 is a hydraulic motor that swingably drives the swing structure 20. The boom cylinder 84, the arm cylinder 85, the attachment cylinder 86, the lift cylinder 87, the angle cylinder 88, and the tilt cylinder 89 are as described above.

Directional Control Valve Unit

The directional control valve unit 36 includes a plurality of directional control valves (not illustrated) of a pilot driven type not illustrated. Each directional control valve is driven by a pilot pressure output from a corresponding one of the pressure reducing valves 71 to 79, controls the direction (or the direction and flow rate) of the hydraulic operating oil delivered from the hydraulic pumps 30*a* and 30*b*, and supplies the hydraulic operating oil to the corresponding hydraulic actuator.

Pressure Reducing Valves

The pressure reducing valves 71 to 79 use hydraulic operating oil delivered from a pilot pump (not illustrated) as a primary pressure, and generate and output a pilot pressure according to an operation of the operator. The pressure reducing valves 71 to 79 operate when operations of corresponding operation devices (for example, the control lever 33) are mechanically transmitted to the pressure reducing valves 71 to 79. FIG. 3 illustrates one pressure reducing valve in correspondence with each hydraulic actuator to prevent complexity of the drawing. In actuality, however, there is a pressure reducing valve corresponding to each driving direction of each hydraulic actuator, and thus, there are two pressure reducing valves for each of the pressure reducing valves 71 to 79.

The pressure reducing valve 71 is a pressure reducing valve that outputs a pilot pressure to a directional control valve corresponding to the left travelling motor 81. There are two pressure reducing valves 71 for forward travelling operation of the left track device 11 and for backward travelling operation of the left track device 11. These are operated by the travelling lever 32 (FIG. 1) on a left side. For example, when the left travelling lever 32 is tipped forward, the left track device 11 travels forward, and when the left travelling lever 32 is tipped backward, the left track device 11 travels backward.

The pressure reducing valve 72 is a pressure reducing valve that outputs a pilot pressure to a directional control valve corresponding to the right travelling motor 82. There are two pressure reducing valves 72 for forward travelling operation of the right track device 11 and for backward travelling operation of the right track device 11. These are operated by the travelling lever 32 on a right side. For example, when the right travelling lever 32 is tipped forward, the right track device 11 travels forward, and when the right travelling lever 32 is tipped backward, the right track device 11 travels backward.

The pressure reducing valve 73 is a pressure reducing valve that outputs a pilot pressure to a directional control valve corresponding to the swing motor 83. There are two pressure reducing valves 73 for right swing operation of the swing structure 20 and for left swing operation of the swing structure 20. These are operated by one of the left and right control levers 33 (FIG. 1). For example, when the left control lever 33 is tipped forward, the swing structure 20 swings in a clockwise direction as viewed in plan, and when the left control lever 33 is tipped backward, the swing structure 20 swings in a counterclockwise direction.

The pressure reducing valve 74 is a pressure reducing valve that outputs a pilot pressure to a directional control valve corresponding to the boom cylinder 84. There are two pressure reducing valves 74 for boom raising operation (for extending the boom cylinder 84) and for boom lowering operation (for contracting the boom cylinder 84). These are operated by one of the left and right control levers 33 (FIG. 1). For example, when the right control lever 33 is tipped forward, the boom 42 operates in a lowering direction, and when the right control lever 33 is tipped backward, the boom 42 operates in a rising direction.

The pressure reducing valve 75 is a pressure reducing valve that outputs a pilot pressure to a directional control valve corresponding to the arm cylinder 85. There are two pressure reducing valves 75 for arm crowding operation (for extending the arm cylinder 85) and for arm dumping operation (for contracting the arm cylinder 85). These are operated by one of the left and right control levers 33 (FIG. 1). For example, when the left control lever 33 is tipped to the left, the arm 43 operates in a dumping direction, and when the left control lever 33 is tipped to the right, the arm 43 operates in a crowding direction.

The pressure reducing valve 76 is a pressure reducing valve that outputs a pilot pressure to a directional control valve corresponding to the attachment cylinder 86. There are two pressure reducing valves 76 for attachment crowding operation (for extending the attachment cylinder 86) and for attachment dumping operation (for contracting the attachment cylinder 86). These are operated by one of the left and right control levers 33 (FIG. 1). For example, when the right control lever 33 is tipped to the left, the attachment 44 operates in a crowding direction, and when the right control lever 33 is tipped to the right, the attachment 44 operates in a dumping direction.

The pressure reducing valve 77 is a pressure reducing valve that outputs a pilot pressure to a directional control valve corresponding to the lift cylinder 87. There are two pressure reducing valves 77 for an operation of lowering the blade 52 (for extending the lift cylinder 87) and for an operation of raising the blade 52 (for contracting the lift cylinder 87). These are operated by a corresponding control lever (not illustrated) disposed in the vicinity of the cab seat 24. For example, when the control lever is operated to one side, the blade 52 rises, and when the control lever is operated to another side, the blade 52 lowers.

The pressure reducing valve 78 is a pressure reducing valve that outputs a pilot pressure to a directional control valve corresponding to the angle cylinder 88. There are two pressure reducing valves 78 for a right retreating operation of the blade 52 (for extending the angle cylinder 88) and for a left retreating operation of the blade 52 (for contracting the angle cylinder 88). These are operated by a corresponding control lever (not illustrated) disposed in the vicinity of the cab seat 24. For example, when the control lever is operated to one side, the blade 52 is inclined such that the right side of the blade 52 is retreated, and when the control lever is operated to another side, the blade 52 is inclined such that the left side of the blade 52 is retreated.

The pressure reducing valve 79 is a pressure reducing valve that outputs a pilot pressure to a directional control valve corresponding to the tilt cylinder 89. There are two pressure reducing valves 79 for a leftwardly downward operation of the blade 52 (for extending the tilt cylinder 89) and for a rightwardly downward operation of the blade 52 (for contracting the tilt cylinder 89). These are operated by a corresponding control lever (not illustrated) disposed in the vicinity of the cab seat 24. For example, when the control lever is operated to one side, the blade 52 is inclined rightwardly downward, and when the control lever is operated to another side, the blade 52 is inclined leftwardly downward.

Automatic Control Valve Unit

The automatic control valve unit 34 is a valve group for performing automatic control of the earth removal device 50 (which automatic control will also be referred to as area limiting excavation control). The automatic control valve unit 34 includes a plurality of electromagnetically driven pressure reducing valves (not illustrated) driven by a signal from the controller 60 or another computer unit. The automatic control of the earth removal device 50 in the present example is linked to 3D data of a design terrain profile of a site to be prepared, and intervenes with operation of the operator and automatically adjusts the operation speed and trajectory of the blade 52 in the vicinity of a target surface when necessary according to a predetermined program so that the ground is not excavated beyond the target surface. What is generally called computer aided construction is performed. At least the lift cylinder 87 of the lift cylinder 87 and the tilt cylinder 89 is a target of the automatic control. When an automatic control function for the earth removal device 50 is enabled, the posture of the blade 52 is automatically controlled such that a lower end of the blade 52 moves along the design terrain profile or the target surface based on the design terrain profile during travelling. Each pressure reducing valve constituting the automatic control valve unit 34 is provided to signal output lines of the pressure reducing valves 74 to 79 operated by the operator or a hydraulic line bypassing the pressure reducing valves 74 to 79 and connecting the pilot pump and the directional control valve unit 36 to each other. The automatic control valve unit 34 generates a pilot pressure according to a command of the controller 60 by using, as a source pressure, a pilot pressure output from the pressure reducing valves 74 to 79 according to operation of the operator or delivery oil of the pilot pump bypassing the pressure reducing valves 74 to 79. This pilot pressure drives the directional control valve unit 36 and thus controls the earth removal device 50.

Controller

The controller 60 is a controller (computer) that calculates various kinds of data and control command values related to machine body control of the hydraulic excavator and outputs electric command signals. The controller 60 includes a CPU, various kinds of memories, and the like. In particular, the controller 60 according to the present embodiment has a function of calculating the orientation of the track structure 10 (which orientation will hereinafter be abbreviated to a track structure orientation) on the basis of positional data regarding one GNSS antenna 94*a* and calculating the positional data regarding the blade 52. The controller 60 performs control of raising or lowering the blade 52 so as to approach the target surface stored in advance, on the basis of the calculated positional data regarding the blade 52. The calculated positional data regarding the blade 52 is, for example, data in the same coordinate system as the 3D data of the design terrain profile (for example, a global coordinate system with respect to the earth) or a coordinate system that can be mutually transformed from and to the above coordinate system (local coordinate system with respect to the hydraulic excavator as an own device). The positional data regarding the blade 52 serves as one basic data for the automatic control of the blade 52. An algorithm for calculating the positional data regarding the blade 52 will be described later.

The controller 60 is supplied with signals from operation sensors 91 and 92, a GNSS receiver 94, stroke sensors 95 and 96, an inclination sensor 97, a swing angle sensor 98, an input device 99, and a mode switch SW. Output destinations of the signals of the controller 60 are typically the automatic control valve unit 34, a monitor 90, and the like.

Related to Input

The operation sensor 91 is a sensor that detects an operation of giving an instruction for operation of the track device 11 on the left side (operation of the travelling lever 32 on the left side). The operation sensor 92 is a sensor that detects an operation of giving an instruction for operation of the track device 11 on the right side (operation of the travelling lever 32 on the right side). Pressure sensors that detect pilot pressures output respectively from the pressure reducing valves 71 and 72 are adopted as the operation sensors 91 and 92. In order to prevent complexity of the drawing, FIG. 3 illustrates only one operation sensor as each of the operation sensors 91 and 92. In actuality, however, two operation sensors are provided as each of the operation sensors 91 and 92 so as to correspond to each of the two pressure reducing valves 71 and 72. Incidentally, the pressure sensors are a mere example of the operation sensors. For example, position sensors (rotary encoders or the like) that detect rotational displacement of each travelling lever 32 can also be adopted as the operation sensors 91 and 92.

The GNSS receiver 94 detects the position (horizontal coordinates and height) of the GNSS antenna 94*a* (FIG. 1) with respect to the earth. GNSS is a general term of positioning systems using satellites. GPS is a kind of GNSS. The GNSS antenna 94*a* can detect the horizontal coordinates (hereinafter referred to as antenna horizontal coordinates) and height (hereinafter referred to as an antenna height) of the GNSS antenna 94*a* with respect to the earth by cooperating with the GNSS receiver 94 that forms a pair with the GNSS antenna 94*a*. Orientation data can be calculated when two GNSS antennas 94*a* are provided. In the present embodiment, however, only one antenna 94*a* is installed on the swing structure 20, as illustrated in FIG. 1 and FIG. 2. The GNSS antenna 94*a* may be installed on the swing structure 20 so as to be offset from a swing center C of the hydraulic excavator, as indicated by a dotted line in FIG. 1. In the present example, however, the GNSS antenna 94*a* is installed on the swing center C (upper portion of the canopy 35) (FIG. 1 and FIG. 2).

The stroke sensor 95 is a sensor that detects a stroke (displacement) of the lift cylinder 87. The stroke sensor 95 is an example of a height sensor for measuring the height (relative height) of the blade 52 (for example, the lower end of a central portion in the left-right direction of the blade 52) with respect to the track structure 10. A sensor capable of detecting a physical quantity related to the relative height of the blade 52 can be replaced with the stroke sensor 95. For example, it is possible to make replacement with a sensor that measures the relative height of the blade 52 by using an electromagnetic wave or an acoustic wave, an angle sensor that measures the angle of the lift arm 51 with respect to the track frame or the angle of the blade 52 with respect to the lift arm 51, or the like.

The stroke sensor 96 is a sensor that detects a stroke (displacement) of the tilt cylinder 89. The stroke sensor 96 is an example of a tilt angle sensor for measuring a tilt angle (relative angle) in a tilt direction (rightwardly downward/leftwardly downward) of the blade 52 with respect to the track structure 10. A sensor capable of detecting a physical quantity related to the tilt angle of the blade 52 can be replaced with the stroke sensor 96. For example, it is possible to make replacement with a sensor that measures the tilt angle of the blade 52 by using an electromagnetic wave or an acoustic wave, an angle sensor that measures the angle in the tilt direction of the blade 52 with respect to the lift arm 51, or the like.

The inclination sensor 97 detects an inclination angle in the forward-rearward direction of the track structure 10 (angle of inclination about an axis extending left and right) and an inclination angle in the left-right direction (angle of inclination about an axis extending in the forward-rearward direction). The inclination sensor 97 is installed in the track structure 10. Typically, an inertial measurement unit (IMU) can be used as the inclination sensor 97.

The swing angle sensor 98 is a sensor that measures the swing angle (relative angle) of the swing structure 20 with respect to the track structure 10. A rotary encoder, for example, can be used as the swing angle sensor 98.

The input device 99 is an input system for the 3D data of the design terrain profile of the site to be prepared. A configuration in which data is loaded into the controller 60 from a recording medium (not illustrated) on which the 3D data is recorded is possible. However, for example, a configuration in which the 3D data is input to the controller 60 by wireless communication with a management server (not illustrated) can be adopted.

The mode switch SW is a switch that turns on and off an automatic calculation mode for the positional data regarding the blade 52. The mode switch SW is provided in the vicinity of the cab seat 24 in the swing structure 20 so as to be reached by a hand of the operator sitting in the cab seat 24.

Related to Output

The monitor 90 is an output device that outputs data (including the positional data regarding the blade 52) calculated by the controller 60 according to a signal from the controller 60. The monitor 90 is provided to the swing structure 20 so as to be located in front of the cab seat 24 (diagonally to the right front of the cab seat 24 in the present example). However, the output device is not limited to an output device of a kind that performs display output of text or a figure, such as the monitor 90. Various output devices can be used together with or in place of the monitor 90, the various output devices including, for example, an output device performing display output using a lamp or the like, an output device performing sound output such as a speaker, an output device such as a printer, an output device performing output to a recording medium, an output device performing wireless output (transmission) of data, and the like. In addition, in the present embodiment, suppose that the controller 60 performs the automatic control of the blade 52 and an operation command signal for the earth removal device 50 based on the positional data regarding the blade 52 is output from the controller 60 to the automatic control valve unit 34. Incidentally, there may be a case where the execution of the automatic control of the blade 52 is shared by another controller unit. In this case, the positional data regarding the blade 52 which positional data is calculated by the controller 60 is output to the computer unit as basic data regarding the automatic control of the blade 52.

—Blade Position Calculating Algorithm—

Figure 4:
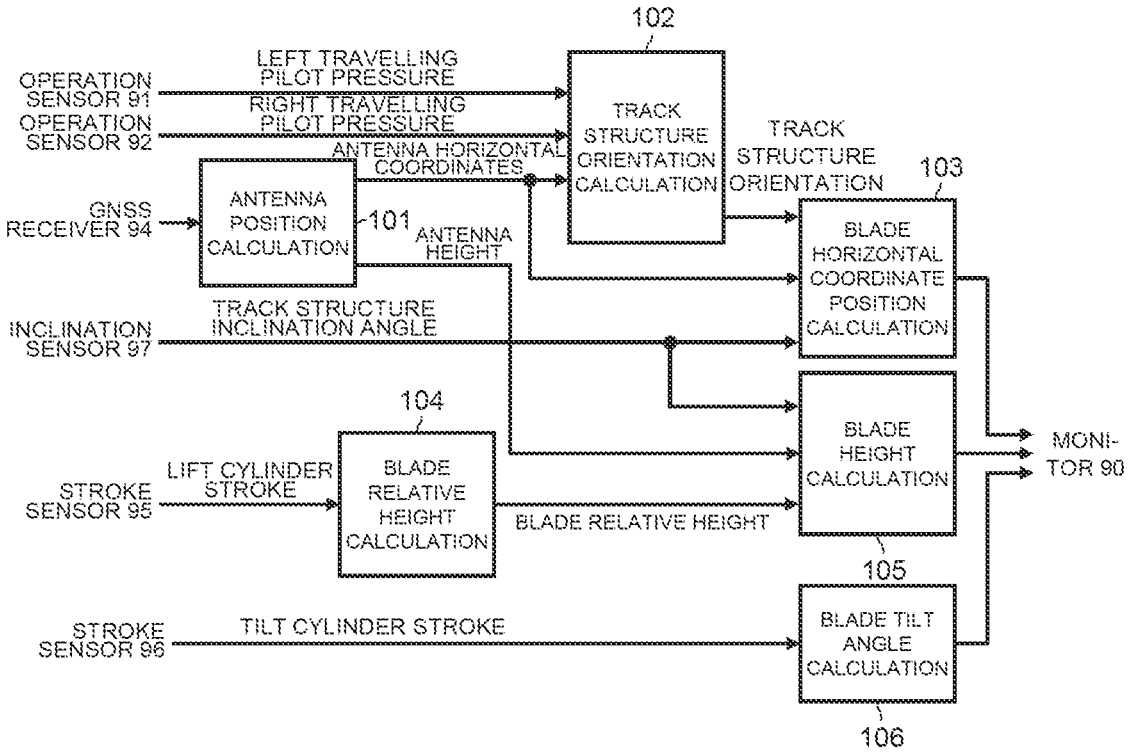
FIG. 4 is a block diagram illustrating an algorithm for calculating the position of a blade by a controller illustrated in FIG. 3.

FIG. 4 is a block diagram illustrating an algorithm for calculating the position of the blade 52 by the controller 60. An essence of this algorithm is to track the antenna horizontal coordinates and identify the track structure orientation from the trajectory of the GNSS antenna 94*a*, to thereby calculate the positional data (horizontal coordinates and height) of the blade 52 on the basis of the track structure orientation and the relative height of the blade 52. The track structure orientation is a direction in which the front (front surface) of the track structure 10 faces (direction in which the earth removal device 50 is located with respect to the swing center C). The calculating algorithm illustrated in the figure includes an antenna position calculation 101, a track structure orientation calculation 102, a blade horizontal coordinate calculation 103, a blade relative height calculation 104, a blade height calculation 105, and a blade tilt angle calculation 106. The antenna position calculation 101 and the like each represent an algorithm of calculating an object value, as a block. However, the antenna position calculation 101 and the like can also be physically configured as a circuit that calculates each object value or a part of the circuit. Of course, a configuration in which a single circuit performs the whole of the calculating algorithm illustrated in FIG. 4 can also be adopted.

In the antenna position calculation 101, the controller 60 calculates the antenna horizontal coordinates and the antenna height. The antenna horizontal coordinates and the antenna height are calculated by the controller 60 on the basis of positional data received by the GNSS antenna 94*a* and input from the GNSS receiver 94. In addition, the antenna horizontal coordinates and the antenna height may be converted into the position (horizontal coordinates and height) of the swing structure 20.

In the track structure orientation calculation 102, the controller 60 calculates the track structure orientation from the trajectory of the antenna horizontal coordinates calculated in the antenna position calculation 101. However, the controller 60 calculates the track structure orientation in a state in which no turn travelling operation is determined as being performed, on the basis of signals of the operation sensors 91 and 92. That is, the controller 60 determines a travelling operation on the basis of the signals of the operation sensors 91 and 92 and calculates the track structure orientation, with the state in which no turn travelling operation is being performed as a precondition. The GNSS antenna 94*a* is installed on the swing structure 20. The moving direction of the GNSS antenna 94*a* can be estimated to be a travelling direction, or in turn the track structure orientation. In the present embodiment, when straight forward travelling of the track structure 10 is detected (the track structure 10 is determined to be travelling straight forward) from the trajectory of the antenna horizontal coordinates (antenna horizontal coordinate tracking data), the travelling direction of the straight forward travelling is calculated as the track structure orientation. Sequential data of the antenna horizontal coordinates is stored in a memory, and the straight forward travelling is detected from the trajectory of the antenna horizontal coordinates reaching a present position. Thus, in the present embodiment, the track structure orientation is calculated during a period until a turn travelling operation is first detected after the straight forward travelling is detected (that is, during a period during which the track structure orientation is maintained). Even when a turn travelling operation is temporarily performed, the track structure orientation is calculated again as long as the straight forward travelling is thereafter detected. A travelling distance of the antenna horizontal coordinates which travelling distance is necessary to determine whether or not the track structure 10 is travelling straight forward depends on accuracy of GNSS. However, a very short distance (approximately a few ten cm, for example) suffices. Incidentally, turn travelling refers to an operation of the track structure 10 in which operation the track structure orientation changes. In the specification of the present application, not only movement travelling involving turning either left or right but also a pivot turn (also referred to as a spin turn) in which the track structure 10 rotates on the spot and a machine body position does not change will be treated as turn travelling.

In the blade horizontal coordinate calculation 103, the controller 60 calculates the horizontal coordinates of the blade 52 (which horizontal coordinates will hereinafter be abbreviated to blade horizontal coordinates) with respect to the earth on the basis of the track structure orientation, the antenna horizontal coordinates, and a measured value of the inclination sensor 97 (which measured value will hereinafter be referred to as a track structure inclination angle). The horizontal coordinates of the center of the blade 52 (for example, a lower surface thereof) are set as the blade horizontal coordinates. In the present embodiment, the GNSS antenna 94*a* is disposed at the swing center C, and therefore, relative positional relation between the GNSS antenna 94*a* and the earth removal device 50 (for example, a pivot of the lift arm 51) does not change irrespective of the swing angle of the swing structure 20. Machine body data related to the positional relation between the GNSS antenna 94*a* and the earth removal device 50 (for example, the pivot of the lift arm 51) is known and is stored in the memory. Hence, the blade horizontal coordinates can be calculated from the antenna horizontal coordinates, the track structure orientation, and the track structure inclination angle. The calculated track structure orientation, the calculated blade horizontal coordinates, and data indicating whether or not the automatic control of the earth removal device 50 is being performed are output from the controller 60 to the output device (for example, the monitor 90).

In the blade relative height calculation 104, the controller 60 calculates the height of the blade 52 (for example, the center of the lower surface) with respect to the GNSS antenna 94*a* (which height will hereinafter be referred to as a blade relative height) from the measured value of the stroke sensor 95 and the above-described machine body data. The above-described machine body data is data regarding the positional relation between the GNSS antenna 94*a* and the earth removal device 50 (for example, the pivot of the lift arm 51). In the present embodiment, a data table in which the above-described machine body data is taken into consideration with regard to relation between the measured value and the blade relative height is stored in the memory in advance, and the controller 60 refers to the data table and calculates the blade relative height corresponding to the measured value of the stroke sensor 95. Because the data regarding the positional relation between the GNSS antenna 94*a* and the earth removal device 50 is known, the blade relative height can also be calculated as needed by the controller 60 using a predetermined computation equation from the measured value of the stroke sensor 95.

In the blade height calculation 105, the controller 60 calculates the height of the blade 52 (for example, the center of the lower surface) (which height will hereinafter be abbreviated to a blade height) with respect to the earth on the basis of the antenna height, the track structure inclination angle, and the blade relative height. The calculated blade height is output from the controller 60 to the output device (for example, the monitor 90) together with the blade horizontal coordinates.

In the blade tilt angle calculation 106, the controller 60 calculates the tilt angle of the blade 52 (which tilt angle will hereinafter be abbreviated to a blade tilt angle) on the basis of the measured value of the stroke sensor 96. A state in which the lower surface of the blade 52 is parallel with the ground contact surface of the track structure 10 is set as a reference (zero degrees) for the blade tilt angle. For example, an inclination angle when the lower surface of the blade 52 is rightwardly downward is set as a positive inclination angle, and an inclination angle when the lower surface of the blade 52 is leftwardly downward is set as a negative inclination angle. Suppose in this case that the blade tilt angle is an angle relative to the track structure 10. However, the blade tilt angle may be converted into a value with respect to the earth, and the value may be output. The calculated blade tilt angle is output from the controller 60 to the output device (for example, the monitor 90) together with the blade horizontal coordinates and the blade height.

—Operation—

Figure 5:
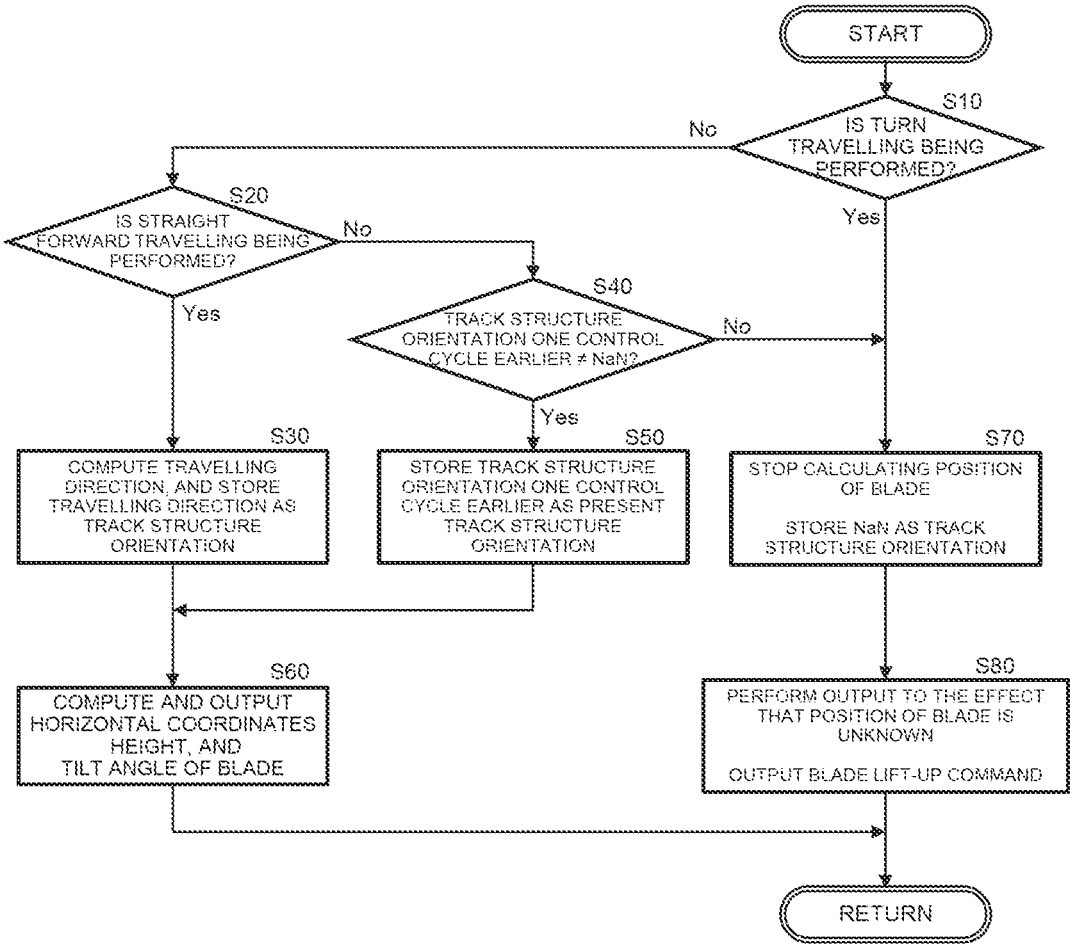
FIG. 5 is a flowchart illustrating a procedure for outputting the positional data regarding the blade by the controller illustrated in FIG. 3.

FIG. 5 is a flowchart illustrating a procedure for outputting the positional data regarding the blade 52 by the controller 60. The procedure illustrated in the figure is not performed when a manual operation mode for the blade 52 is selected by the mode switch SW (FIG. 3) and is performed by the controller 60 only when power is on and the automatic calculation mode for the positional data regarding the blade 52 is selected. The procedure of the figure is repeatedly performed in short control cycles (for example, 1 ms).

Step S10

When the controller 60 starts the processing of the figure, the controller 60 determines whether or not the hydraulic excavator (track structure 10) is performing turn travelling, on the basis of the signals of the operation sensors 91 and 92, as part of the track structure orientation calculation 102. It is determined, as part of the track structure orientation calculation 102, that turn travelling is being performed, for example, when both of the left and right travelling levers 32 are operated in different directions, when only one of the left and right travelling levers 32 is operated, or when both of the left and right travelling levers 32 are operated in the same direction but there is a difference exceeding a set value between operation amounts thereof. When turn travelling is not being performed, the controller 60 shifts the procedure to step S20. When turn travelling is being performed, the controller 60 shifts the procedure to step S70.

Step S20

In step S20, the controller 60 determines whether or not the track structure 10 is performing straight forward travelling, as part of the track structure orientation calculation 102, on the basis of the trajectory of the antenna horizontal coordinates calculated in the antenna position calculation 101. The straight line travelling is a travelling operation in which the orientation of the track structure 10 is uniform, and can be determined on the basis of whether the curvature of the trajectory of the antenna horizontal coordinates is 0 (zero) or less than a set value. When the straight forward travelling is being performed, the controller 60 shifts the procedure to step S30. When the straight forward travelling is not being performed, the controller 60 shifts the procedure to step S40.

Step S30

In step S30, the controller 60 computes the travelling direction of the hydraulic excavator from the trajectory of the antenna horizontal coordinates as the track structure orientation calculation 102 and stores the computed travelling direction as the track structure orientation in the memory. The controller 60 then shifts the procedure to step S60.

Step S40

In a case where the antenna horizontal coordinates are not shifted during a stop or the like, the controller 60 shifts the procedure from step S20 to step S40, where the controller 60 determines as part of the track structure orientation calculation 102 whether or not the track structure orientation stored one control cycle earlier is a valid value (not NaN: Not a Number). Even when straight forward travelling is not currently being performed, a valid value (a value other than NaN) of the track structure orientation is stored as long as straight forward travelling has been performed in the past and turn travelling is not thereafter performed (unless the track structure orientation one control cycle earlier is NaN) (steps S30, S50, and S70). When the value of the track structure orientation stored one control cycle earlier is a valid value (≠NaN), the controller 60 shifts the procedure from step S40 to step S50. When the value of the track structure orientation stored one control cycle earlier is an invalid value (=NaN), the controller 60 shifts the procedure to step S70 as in the case where turn travelling is being performed.

Step S50

In step S50, the controller 60 stores the value of the track structure orientation one control cycle earlier which value is stored in the memory, as part of the track structure orientation calculation 102, as the value of the track structure orientation in a present control cycle, in the memory. The controller 60 then shifts the procedure to step S60.

Step S60

In step S60, the controller 60 calculates the blade horizontal coordinates on the basis of the present track structure orientation and the machine body data (the blade horizontal coordinate calculation 103 in FIG. 3) and calculates the blade height and the blade tilt angle (the blade height calculation 105 and the blade tilt angle calculation 106 in the figure). The calculated blade horizontal coordinates, the calculated blade height, and the calculated blade tilt angle are output to the output device (for example, the monitor 90). After the controller 60 thus outputs the calculated values to the output device, the controller 60 returns the procedure to step S10.

Step S70

When turn travelling of the track structure 10 is detected, or when the antenna horizontal coordinates are not shifted straight forward and the value of the track structure orientation one control cycle earlier is NaN, the controller 60 shifts the procedure to step S70. In step S70, the controller 60 stops calculating the positional data (horizontal coordinates and height) of the blade 52, and stores NaN (Not a Number) indicating that the track structure orientation is unknown as the value of the track structure orientation, as part of the track structure orientation calculation 102. The controller 60 then shifts the procedure to step S80.

Step S80

The positional data regarding the blade 52 is not computed in a state in which the track structure orientation is unknown. In step S80, the controller 60 performs output to the output device to the effect that the position of the blade 52 is unknown. The controller 60 then returns the procedure to step S10. Thus, the controller 60 stops calculating the horizontal coordinates and height of the blade 52 while a turn travelling operation is detected. When output is performed from the controller 60 to the effect that the position of the blade 52 is unknown, the output device performs output to that effect (for example, display output is performed on the monitor 90 to that effect).

In addition, in step S80, while the controller 60 performs output to the effect that the position of the blade 52 is unknown, the controller 60 outputs, to the automatic control valve unit 34, a command to raise the lower end of the blade 52 to a position (for example, an upper limit of a movable range) higher than the ground contact surface of the track structure 10. Consequently, a pilot pressure is output from the automatic control valve unit 34 to the directional control valve corresponding to the lift cylinder 87, the lift cylinder 87 contracts, and the blade 52 rises. The lower end of the blade 52 is thus separated from the target surface by forcibly raising the blade 52 during the stop of calculation of the positional data regarding the blade 52.

As described above, with a state in which turn travelling operation is not performed as a precondition, the positional data regarding the blade 52 is calculated during a period from a time of detection of straight forward travelling on the basis of the trajectory of the antenna horizontal coordinates to a subsequent first detection of turn travelling operation. Then, on the basis of the calculated blade horizontal coordinates, the calculated blade height, the calculated blade tilt angle, and the design terrain profile, the controller 60 (or another computer unit) controls the lift cylinder 87 and the tilt cylinder 89, so that the blade 52 follows the target surface. When the hydraulic excavator is made to travel forward throughout a work area, the blade 52 following the target surface creates the design terrain profile. At the same time, the output device outputs the positional data regarding the blade 52 (the blade horizontal coordinates, the blade height, and the blade tilt angle) which positional data is input from the controller 60. For example, the positional data regarding the blade 52 is output for display on the monitor 90 together with the data of the design terrain profile. Alternatively, graphics illustrating the positional relation between the blade 52 and the design terrain profile, data indicating whether or not the automatic control of the blade is being performed, or the like is output for display. By referring to the positional data regarding the blade 52 which positional data is output for display on the monitor 90 as needed, the operator can perform operation flexibly while determining conditions.

—Advantages—

(1) According to the present embodiment, it is possible to identify the track structure orientation from the positional data regarding one GNSS antenna 94*a* and calculate the positional data regarding the blade 52 from the track structure orientation and the measured values of the stroke sensors 95 and 96 and the inclination sensor 97. The positional data regarding the blade 52 can be calculated with the GNSS antenna 94*a* installed on the swing structure 20. Thus, the GNSS antenna 94*a* does not need to be installed on the blade 52, so that contact between soil or the work implement 40 and the GNSS antenna 94*a* can be avoided. The position of the blade 52 can be computed using a small number of sensors. In addition, because a plurality of expensive GNSS antennas 94*a* are not necessary, a reduction in machine body price leads to the widespread use of computer aided construction machines and can in turn widely contribute to an improvement in efficiency of the work of creating a site to be prepared. In addition, when there is much basic data for the calculation of the positional data regarding the blade 52, there is a fear of complication of the calculation and a decrease in response speed. However, because a system is established using a small number of sensors (basic data) as in the present embodiment, the calculation can be simplified, and an excellent responsiveness can be ensured.

In addition, when a turn travelling operation is detected, the calculation of the positional data regarding the blade 52 including the blade horizontal coordinates and the blade height is stopped. The calculation of the track structure orientation is limited to a situation in which straight forward travelling is being performed and the trajectory of the GNSS antenna 94*a* per se can be regarded as the track structure orientation (step S30) and a situation in which straight forward travelling is not being performed but the track structure orientation is not changed after straight forward travelling (step S50). During a period from a point of time that the straight forward travelling of the track structure 10 is detected to a first detection of turn travelling of the track structure 10, the linear trajectory of the antenna horizontal coordinates per se is calculated as the track structure orientation. Therefore, contribution is also made to an improvement in accuracy of calculation of the track structure orientation, or in turn accuracy of the automatic control of the blade 52, and responsiveness can be further improved by simplification of the calculation of the track structure orientation.

Incidentally, in the present embodiment, a case in which the measured value of the stroke sensor 96 of the tilt cylinder 89 is included as basic data for the calculation of the positional data regarding the blade 52 has been illustrated because the hydraulic excavator having a function of tilting the blade 52 is set as an application target. However, the present invention is also applicable to hydraulic excavators not having the function of tilting the blade 52. In this case, the sensor related to the tilt angle can of course be omitted. Similarly, the angle cylinder 88 can also be omitted. The inclination sensor 97 can also be omitted in a case where the ground is level and the inclination of the track structure 10 thus does not need to be considered. In addition, though description of a stroke sensor of the angle cylinder 88 (or a sensor that detects an inclination in an angle direction) is omitted, there is a case where creation work is performed with the blade 52 inclined in the angle direction. When such work is also taken into consideration, a configuration in which a measured value of an angle in the angle direction is obtained and output as the positional data regarding the blade 52 can also be adopted.

(2) By raising the blade 52 during a stop of the calculation of the positional data regarding the blade 52, it is possible to avoid the automatic control of the blade 52 based on data lacking validity and prevent the terrain profile from being scraped beyond the target surface.

(3) Because the GNSS antenna 94*a* is installed at the swing center C, the positional relation between the GNSS antenna 94*a* and the earth removal device 50 does not change irrespective of the relative swing angle of the swing structure 20 with respect to the track structure 10. In actual work, the swing structure 20 can be swung during the calculation of the track structure orientation. However, even when the swing structure 20 is swung, the calculation of the track structure orientation is not affected, and it is not necessary to stop calculating the track structure orientation after detecting a swing. In addition, because the swing angle does not need to be considered in calculating the track structure orientation, or in turn the position of the blade 52, a calculation volume is reduced, and responsiveness can be improved more.

Second Embodiment

Figure 6:
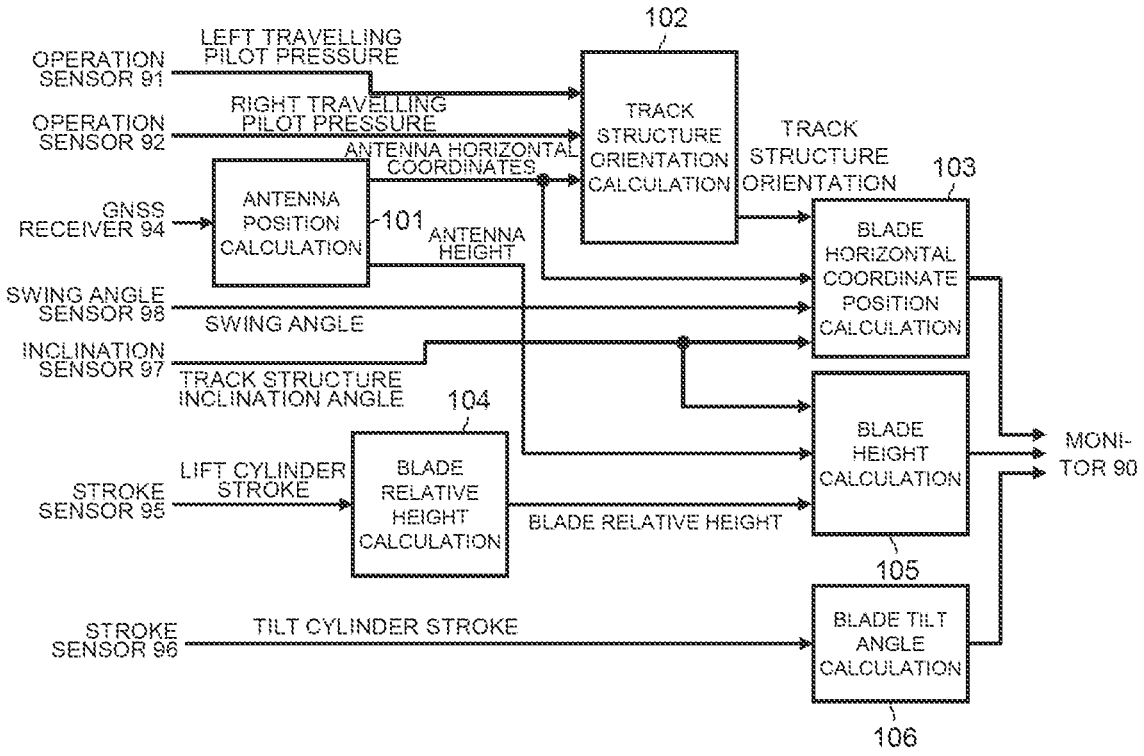
FIG. 6 is a block diagram illustrating an algorithm for calculating the position of a blade by a controller provided to a hydraulic excavator according to a second embodiment of the present invention.
Figure 7:
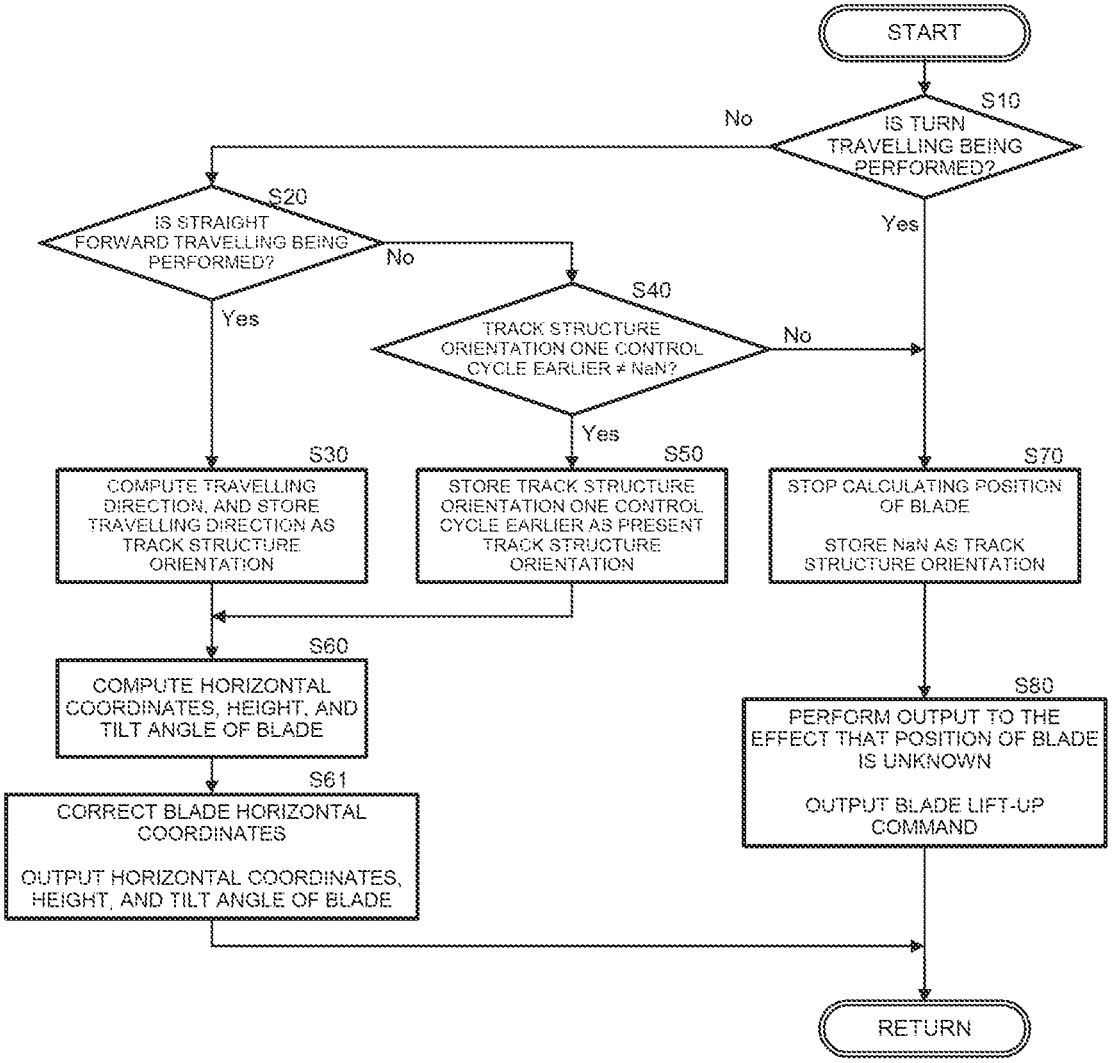
FIG. 7 is a flowchart illustrating a procedure for outputting the positional data regarding the blade by the controller provided to the hydraulic excavator according to the second embodiment of the present invention.

FIG. 6 is a block diagram illustrating an algorithm for calculating the position of a blade by a controller provided to a hydraulic excavator according to a second embodiment of the present invention. FIG. 7 is a flowchart illustrating a procedure for outputting the positional data regarding the blade by the controller. FIG. 6 and FIG. 7 are diagrams corresponding to FIG. 4 and FIG. 5 in the first embodiment. In FIG. 6 and FIG. 7, elements sharing reference characters with those in FIG. 4 and FIG. 5 represent algorithms or processing identical to or corresponding to the elements having the same reference characters in FIG. 4 and FIG. 5, and description thereof will be omitted as appropriate.

The present embodiment is different from the first embodiment in that the swing angle sensor 98, which can be omitted in the first embodiment, is essential, and the controller 60 is programmed to correct the blade horizontal coordinates on the basis of the measured value of the swing angle sensor 98. In addition, the GNSS antenna 94*a* is assumed to be installed at a position different from the swing center C (offset from the swing center C).

In the case where the GNSS antenna 94*a* is disposed at the swing center C as in the first embodiment, the positional relation between the GNSS antenna 94*a* and the earth removal device 50 does not change irrespective of the relative swing angle of the swing structure 20 with respect to the track structure 10. However, in a case where the GNSS antenna 94*a* has to be disposed on the swing structure 20 so as to be offset from the swing center C, the positional relation between the GNSS antenna 94*a* and the earth removal device 50 changes depending on the relative swing angle of the swing structure 20 with respect to the track structure 10. In this case, when there is a difference between the direction in which the front of the swing structure 20 faces (which direction will hereinafter be referred to as a swing structure orientation) and the track structure orientation, an error occurs in the blade horizontal coordinates calculated on the basis of the positional data regarding the GNSS antenna 94*a*. The present embodiment assumes a configuration in which only one GNSS antenna 94*a* is provided and is installed on the swing structure 20 so as to be offset from the swing center C, and includes a function of correcting an error that can occur in the blade horizontal coordinates.

As illustrated in FIG. 6, in an algorithm for calculating the positional data regarding the blade 52 by the controller 60 according to the present embodiment, the measured value of the swing angle sensor 98 is added as basic data for computing the blade horizontal coordinates in the blade horizontal coordinate calculation 103. For example, the blade horizontal coordinates are calculated on the basis of the track structure orientation calculated in the track structure orientation calculation 102 and the like as in the first embodiment, and the blade horizontal coordinates are corrected on the basis of the measured value of the swing angle sensor 98 (that is, relation between the track structure orientation and the antenna horizontal coordinates). Other calculating algorithms are similar to the calculating algorithms of the first embodiment illustrated in FIG. 4.

In the procedure of FIG. 7, in the present embodiment, after the processing of step S60, the controller 60 corrects the stored present blade horizontal coordinates as described above, then outputs the corrected present blade horizontal coordinates to the output device, and returns the procedure to step S10 (step S61). The other steps are similar to the steps of the first embodiment illustrated in FIG. 5.

In addition to effects similar to those of the first embodiment, the present embodiment has an advantage of being able to calculate the blade horizontal coordinates with high accuracy even when the GNSS antenna 94*a* is installed on the swing structure 20 so as to be offset from the swing center C. The correction of the track structure orientation on the basis of the relative angle of the swing structure 20 with respect to the track structure 10 is applicable also to a following third embodiment and can produce a similar effect also in the third embodiment.

Third Embodiment

Figure 8:
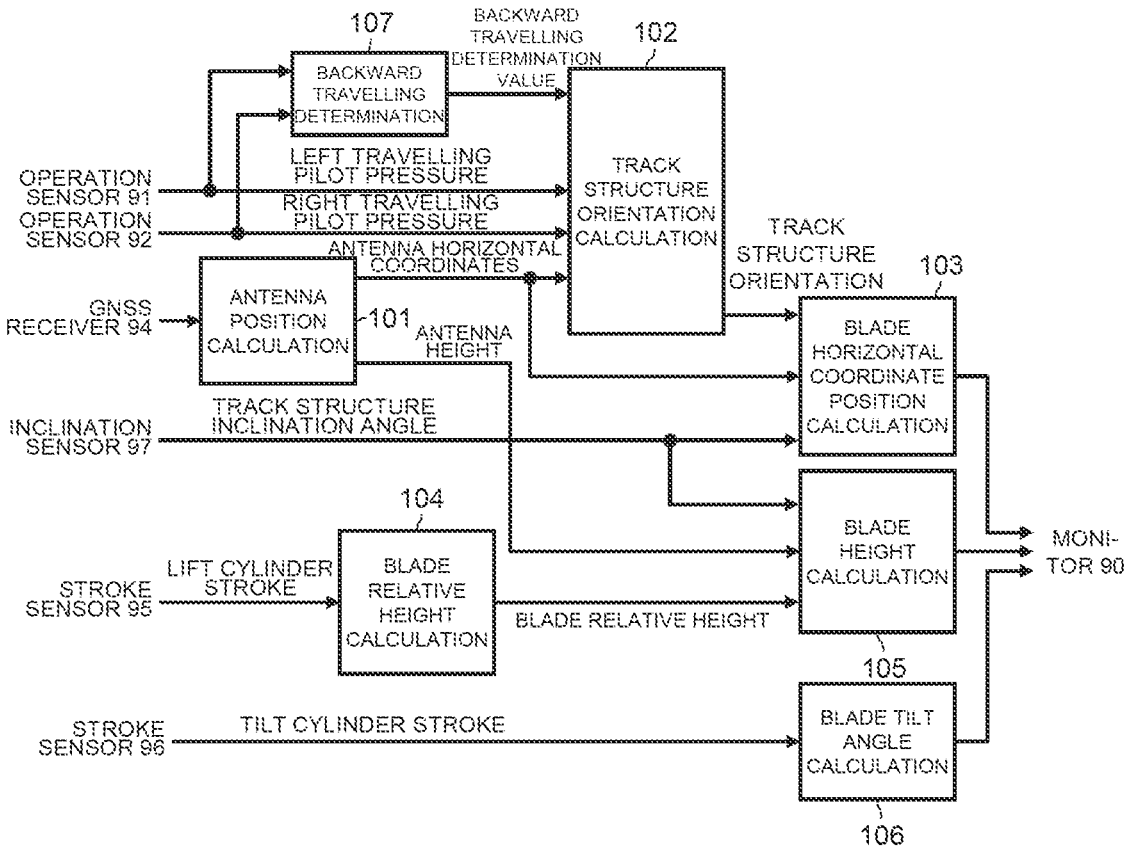
FIG. 8 is a block diagram illustrating an algorithm for calculating the position of a blade by a controller provided to a hydraulic excavator according to a third embodiment of the present invention.
Figure 9:
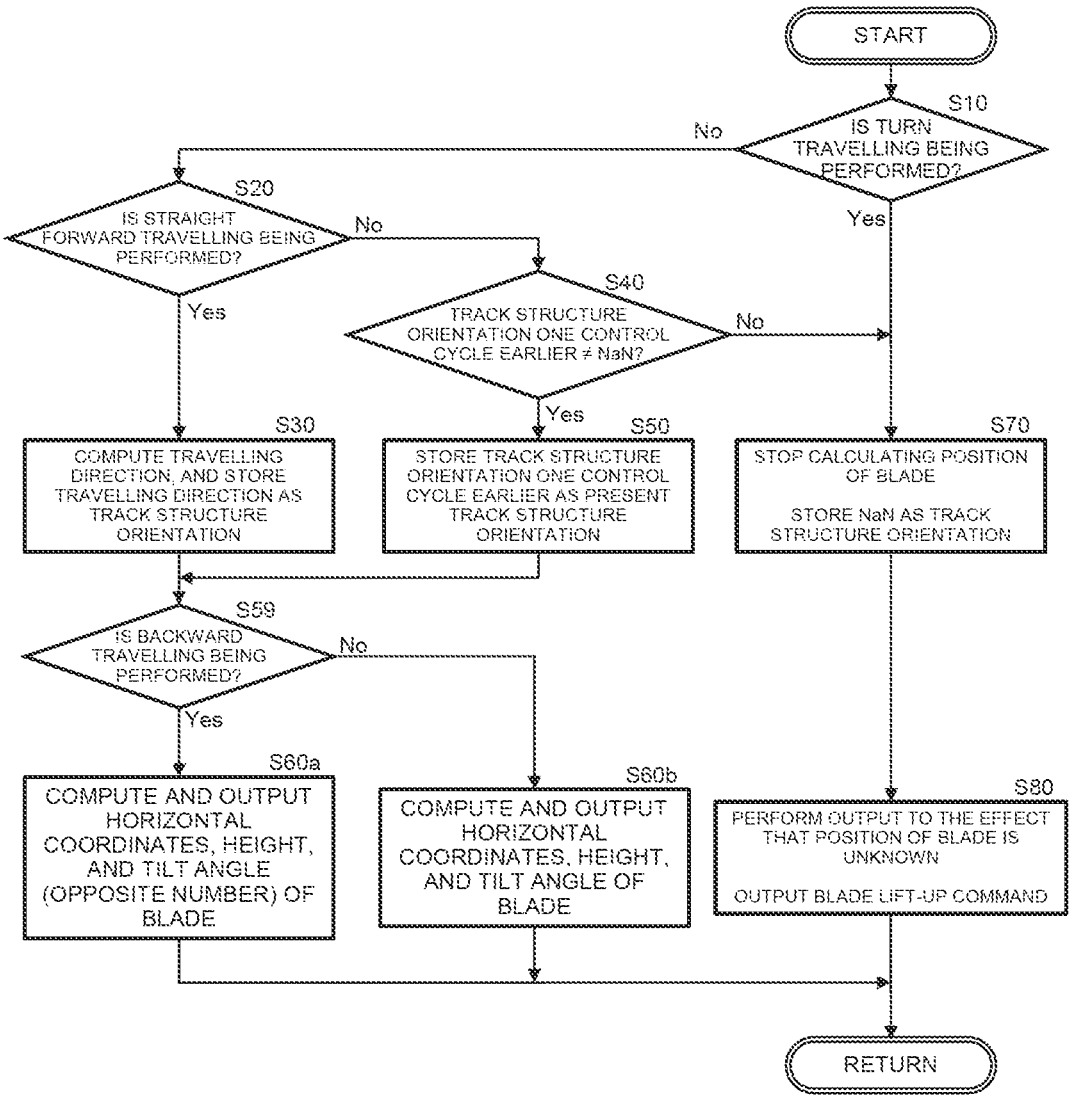
FIG. 9 is a flowchart illustrating a procedure for outputting the positional data regarding the blade by the controller provided to the hydraulic excavator according to the third embodiment of the present invention.

FIG. 8 is a block diagram illustrating an algorithm for calculating the position of a blade by a controller provided to a hydraulic excavator according to a third embodiment of the present invention. FIG. 9 is a flowchart illustrating a procedure for outputting the positional data regarding the blade by the controller. FIG. 8 and FIG. 9 are diagrams corresponding to FIG. 4 and FIG. 5 in the first embodiment. In FIG. 8 and FIG. 9, elements sharing reference characters with those in FIG. 4 and FIG. 5 represent algorithms or processing identical to or corresponding to elements having the same reference characters in FIG. 4 and FIG. 5, and description thereof will be omitted as appropriate.

The present embodiment is different from the first embodiment in that whether forward travelling is being performed or backward travelling is being performed is determined on the basis of a travelling operation, and when it is determined that backward travelling is being performed, the value of the blade tilt angle is calculated so as to have a positive or negative sign opposite from that at a time of forward travelling.

As illustrated in FIG. 8, a backward travelling determination 107 is added to an algorithm for calculating the positional data regarding the blade 52 by the controller 60 according to the present embodiment. The controller 60 determines whether backward travelling is being performed (whether both of the travelling levers 32 are operated in a backward travelling direction) on the basis of the signals of the operation sensors 91 and 92. When backward travelling is being performed, the controller 60 sets a backward travelling determination value in an on state and outputs the backward travelling determination value in the on state (for example, the backward travelling determination value=1). When backward travelling is not being performed, the controller 60 sets the backward travelling determination value in an off state and outputs the backward travelling determination value in the off state (for example, the backward travelling determination value=0).

In addition, in the blade tilt angle calculation 106, when the backward travelling determination value is in an on state, the controller 60 calculates, as the blade tilt angle, an opposite number of the blade tilt angle calculated in a manner similar to the first embodiment at a time of forward travelling, for example. The opposite number is a value having an opposite positive or negative sign (−a for a). As for the blade tilt angle, a state in which the blade 52 is horizontal is set as 0 (zero). An inclination angle at which the blade 52 is rightwardly downward, for example, is set as a positive value, and an inclination angle at which the blade 52 is leftwardly downward is set as a negative value. The state in which the blade 52 is horizontal refers to a state in which the relative angle of the blade 52 with respect to the track structure 10 is zero (specifically, a state in which the ground contact surface of the track structure 10 and a lower edge of the blade 52 are horizontal to each other). For example, in a case where the blade tilt angle is calculated as 8 degrees from the measured value of the stroke sensor 96, the blade tilt angle is calculated as 8 degrees as it is when the backward travelling determination value is in an off state, and the blade tilt angle is calculated as −8 degrees when the backward travelling determination value is in an on state. The other calculating algorithms are similar to the calculating algorithms of the first embodiment illustrated in FIG. 4.

In the procedure of FIG. 9, the controller 60 determines whether the hydraulic excavator is performing backward travelling (backward travelling determination 107), after performing step S30 or S50. When backward travelling is being performed, the controller 60 shifts the procedure to step S60*a*. When backward travelling is not being performed, the controller 60 shifts the procedure to step S60*b* (step S59). When the controller 60 shifts the procedure to step S60*b*, the controller 60 calculates the blade horizontal coordinates on the basis of the present track structure orientation, to calculate and output the blade height and the blade tilt angle as in step S60 (FIG. 5) of the first embodiment. The controller 60 then returns the procedure to step S10. When the controller 60 shifts the procedure to step S60*a*, on the other hand, the controller 60 obtains the blade horizontal coordinates and the blade height considering that the blade 52 is on a rear side in a travelling direction. As for the blade tilt angle, the opposite number of the value obtained in the same manner as in step S60*b* is calculated. Then, these values are output, and the procedure is returned to step S10. The other steps are similar to the steps of the first embodiment illustrated in FIG. 5.

The present embodiment also provides effects similar to those of the first embodiment. In addition, because backward travelling is detected, the positional data and the tilt angle of the blade 52 can be calculated with high accuracy from the positional data regarding the GNSS antenna 94*a* even at a time of the backward travelling.

To make a supplementary description, it is not possible to determine whether the track structure 10 is performing forward travelling or backward travelling on the basis of only the trajectory of one GNSS antenna 94*a*. As long as the hydraulic excavator is made to travel forward on the site (in a case where backward travelling during the calculation of the position of the blade 52 is not assumed), there is no possibility for the positional data regarding the blade 52 to be calculated erroneously due to misrecognition of the travelling direction in the first embodiment. In addition, even in the case of backward travelling, when turn travelling is being performed, the calculation is stopped, and therefore, erroneous positional data regarding the blade 52 is not calculated. However, there can be a case in which the hydraulic excavator performs straight forward travelling rearward during the calculation of the position of the blade 52 on the site. When the hydraulic excavator performs straight forward travelling rearward, erroneous blade horizontal coordinates are calculated because step S30 in the first embodiment assumes that the blade 52 which, in reality, is located rearward in the travelling direction is located in front in the travelling direction, and further, the blade tilt angle is also calculated erroneously.

Accordingly, the present embodiment detects backward travelling on the basis of a travelling operation and reflects the backward travelling in the calculation of the positional data regarding the blade 52. It is thereby possible to properly calculate the positional data regarding the blade 52 even at a time of the backward travelling. Because the backward travelling during the calculation of the position of the blade 52 is permitted, the degree of freedom of work is increased.

(Modifications)

In the above embodiments, description has been made by illustrating a case where there is one GNSS antenna 94*a*. However, the foregoing embodiments hold even when there are two GNSS antennas 94*a*. It is possible to use the positional data regarding one of the two GNSS antennas 94*a*, or it is possible to use the antenna positional data regarding an intermediate point between the two, for example. In addition, while description has been made of an example in which GNSS is employed for positioning, another satellite positioning system (for example, RNSS) can also be employed.

While a small-sized hydraulic excavator is illustrated in FIG. 1, the present invention is also suitably applicable to medium-sized or larger hydraulic excavators. The present invention is also applicable to a wheel type excavator having a wheel type track structure.

DESCRIPTION OF REFERENCE CHARACTERS

10: Track structure
20: Swing structure
32: Travelling lever
40: Work implement
50: Earth removal device
52: Blade
60: Controller
87: Lift cylinder
89: Tilt cylinder
90: Monitor (output device)
91, 92: Operation sensor
94*a*: GNSS antenna (antenna)
95: Stroke sensor (height sensor)
96: Stroke sensor (tilt angle sensor)
98: Swing angle sensor
C: Swing center

The invention claimed is:

1. A hydraulic excavator comprising a track structure including left and right track devices, a swing structure swingably disposed on an upper portion of the track structure, a work implement coupled to the swing structure, an earth removal device including a blade coupled to the track structure and a lift cylinder configured to raise and lower the blade, a right side travelling lever configured to operate the track device on the right side, a left side travelling lever configured to operate the track device on the left side, a first operation sensor configured to detect an operation of the right side travelling lever, a second operation sensor configured to detect an operation of the left side travelling lever, a height sensor configured to measure a height of the blade with respect to the track structure, an antenna for a satellite positioning system, the antenna being mounted on the swing structure; and a controller configured to calculate positional data regarding the blade and perform control of raising or lowering the blade so as to approach a target surface stored in advance on a basis of the positional data, wherein the controller includes a memory configured to store sequential data of horizontal coordinates of the antenna, and wherein the controller is configured to determine whether or not a turn travelling operation is being performed on a basis of signals of the first operation sensor and the second operation sensor, determine whether or not the track structure is performing straight forward travelling from a trajectory of the antenna, the trajectory being obtained from the sequential data stored in the memory, when determining that no turn operation is being performed, and compute, as a track structure orientation, a travelling direction of the track structure, the travelling direction being derived from the trajectory of the horizontal coordinates of the antenna, when determining that the track structure is performing the straight forward travelling, calculate horizontal coordinates of the blade on a basis of the computed orientation of the track structure and data regarding a relation between a position of the antenna and a position of the blade, the data being stored in advance, calculate the height of the blade on a basis of the position of the antenna, a measured value of the height sensor, and the data regarding the relation between the position of the antenna and the position of the blade, the data being stored in advance, and compute the positional data regarding the blade from the calculated horizontal coordinates of the blade and the calculated height of the blade.

2. The hydraulic excavator according to claim 1, wherein the controller stops calculating the horizontal coordinates and height of the blade while a turn travelling operation is detected on the basis of the signals of the first operation sensor and the second operation sensor.

3. The hydraulic excavator according to claim 2, wherein the controller raises the blade while the calculation of the horizontal coordinates and height of the blade is stopped.

4. The hydraulic excavator according to claim 1, wherein the antenna is installed at a swing center of the swing structure.

5. The hydraulic excavator according to claim 1, wherein the antenna is installed at a position different from a swing center of the swing structure, the hydraulic excavator includes a swing angle sensor configured to measure a swing angle of the swing structure with respect to the track structure, and the controller computes the horizontal coordinates of the blade on a basis of the orientation of the track structure, a measured value of the swing angle sensor, and the data regarding the relation between the position of the antenna and the position of the blade, the data being stored in advance.

6. The hydraulic excavator according to claim 1, further comprising:

a tilt cylinder configured to tilt the blade; and a tilt angle sensor configured to measure a tilt angle of the blade, wherein the controller calculates the tilt angle of the blade such that the tilt angle has a positive or negative sign opposite from a sign at a time of forward travelling in a case where the controller determines that backward travelling is being performed on the basis of the signals of the first operation sensor and the second operation sensor when the controller calculates the tilt angle of the blade on a basis of a measured value of the tilt angle sensor.

7. The hydraulic excavator according to claim 1, further comprising:

an output device configured to output the positional data calculated by the controller, wherein the horizontal coordinates and height of the blade are output to the output device.

* * * * *